United States Patent [19]

Higgins

[11] 4,050,219

[45] Sept. 27, 1977

[54] BAGGING MACHINE

[75] Inventor: David M. Higgins, Arlington Heights, Ill.

[73] Assignee: Comptex, Inc., Chicago, Ill.

[21] Appl. No.: 659,587

[22] Filed: Feb. 19, 1976

[51] Int. Cl.[2] ..... B65B 9/10; B65B 43/30

[52] U.S. Cl. ..... 53/183

[58] Field of Search ..... 53/66, 183, 187, 261, 53/384–386, 184 R, 184 S

[56] References Cited

U.S. PATENT DOCUMENTS

| | | | |
|---|---|---|---|
| 3,897,674 | 8/1975 | Higgins | 53/183 X |
| 3,902,303 | 9/1975 | King | 53/187 X |

FOREIGN PATENT DOCUMENTS

| | | | |
|---|---|---|---|
| 2,027,648 | 12/1971 | Germany | 53/183 |

*Primary Examiner*—Robert Louis Spruill

*Attorney, Agent, or Firm*—Henry L. Brinks; Peter E. Heuser

[57] ABSTRACT

A bagging machine for automatically covering a loaded pallet with a bag formed from a tubing of resilient film. The tubing is fed by drive rollers down into the machine where vacuum heads grasp the sides of the tubing and spread it open. Fingers are then inserted and when an appropriate length of tubing is fed onto the fingers, a cut-and-seal mechanism cuts the tubing and seals the end of the bag. The fingers retract to further open and stretch the bag. The carriage in which the fingers are mounted is then lowered and the bag is fed onto the load.

20 Claims, 23 Drawing Figures

FIG. 1
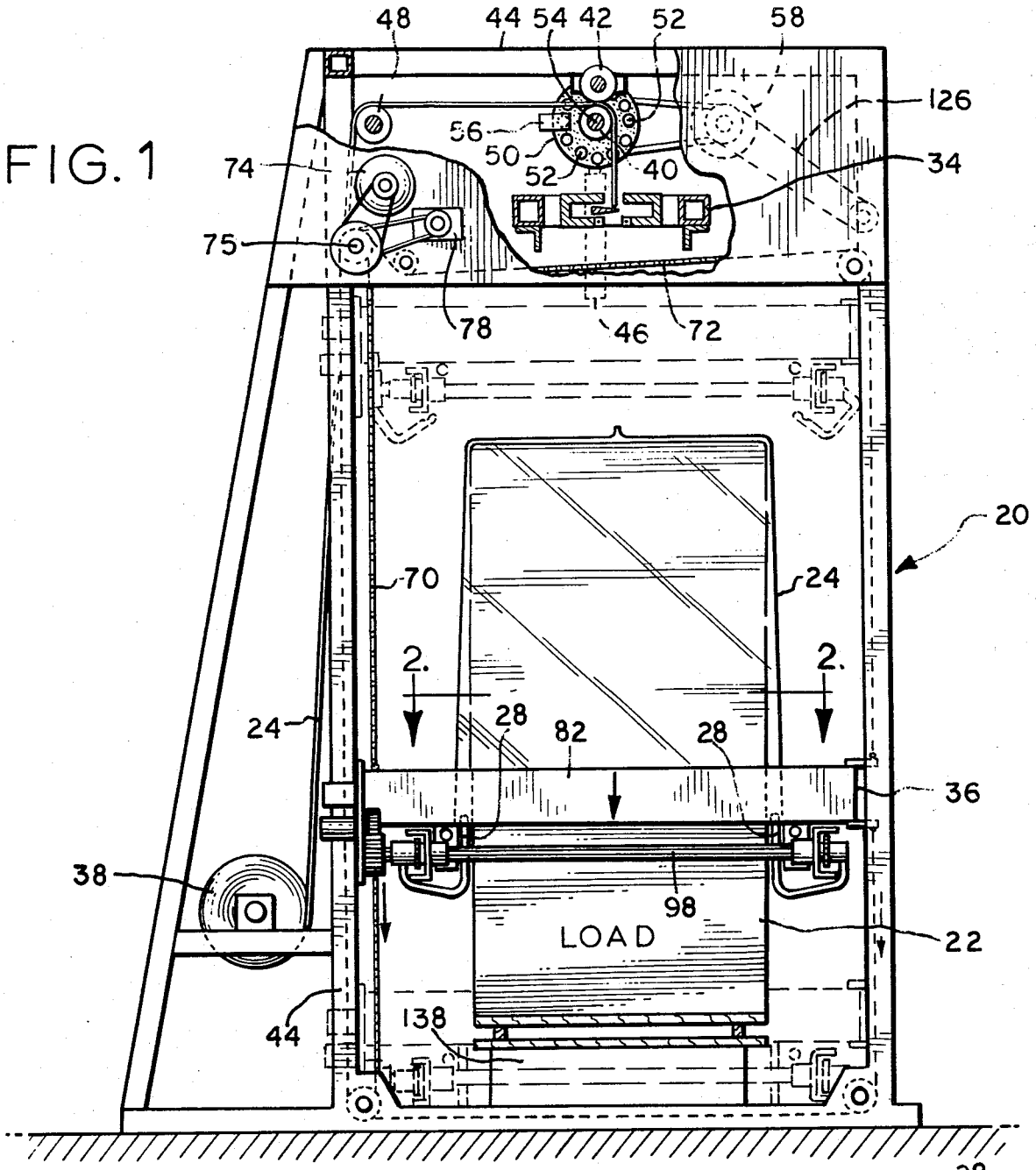
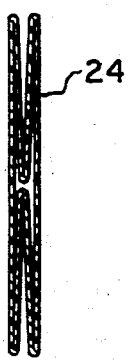
FIG. 2a
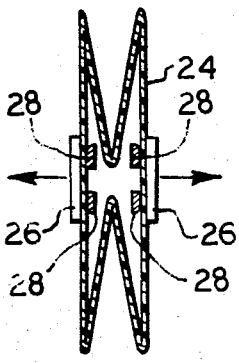
FIG. 2b
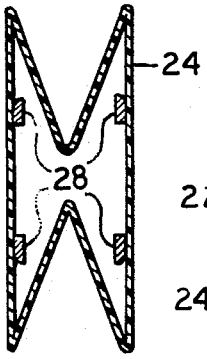
FIG. 2c
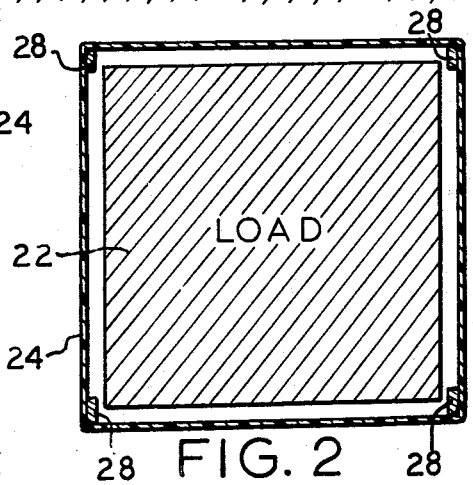
FIG. 2

8.
8.
66
84
90
30
78
76
80
82
92
28
88
70
69
108
110
112
114
116
118
120
A
B
C

BAGGING MACHINE

BACKGROUND OF THE INVENTION

This invention relates to a bagging machine for automatically placing a bag over a load. More particularly, the invention relates to a bagging machine for automatically placing a bag of resilient film over a loaded pallet having varying dimensions.

The prior art has realized a number of difficulties in totally automated bagging operations. By providing an efficient vacuum head system the invention minimizes the power required to pull a vacuum and spread the tubing. The invention provides fingers which spread the tubing in two horizontal directions and thus eliminates the complicated mechanisms required to spread tubing onto fingers which can only move in one horizontal direction. By providing accumulating rollers which tension the bag as it is deposited onto the load, the invention can not only insure even covering, but can also stretch the bag vertically. Accordingly, this invention provides a relatively simple machine which provides a capability of efficient operation with a minimal amount of operator supervision.

SUMMARY OF THE INVENTION

The trolley accepts the loaded pallet and automatically centers the load in relation to the machine. The feed motor is then activated and the drive rollers feed gusseted tubing down into the apparatus. A reader switch determines when the tubing has been fed far enough and the vacuum heads extend to contact each side of the tubing. The heads then retract to open the bag and four fingers are inserted therein. With the fingers inserted the tubing wall is positioned between accumulating rollers and the fingers. The accumulating rollers rotate until they have fed a sufficient amount of tubing onto the fingers, at which time a cut-and-seal mechanism is energized to complete formation of the bag. The proper amount of tubing to be deposited on the fingers is determined by the sensor which measures the dimensions of the loaded pellet. After the bag is formed and collected on the fingers, the fingers retract to stretch the bag so to encompass the load. Relative vertical movement is then effected between the load and the fingers so that the bag is fed onto the load. While ordinarily this will involve the lowering of the carriage in which the fingers are mentioned, it may be desireable in some operations to raise the load. As the bag is being fed onto the load the accumulating rollers act to stretch the bag in a vertical direction. When the load is completely covered the carriage or the load is returned to its original position to prepare for the next bagging operation.

Thus, the primary object of this invention is to provide a bagging machine for automatically covering a loaded pallet with a bag where the pallets are of varying dimensions. A second object is to provide a bagging machine which can be used in stretch-bagging as well as heat-shrink-bagging operations. Yet another object is to provide a stretch bagging machine which can stretch the bag in a vertical as well as horizontal direction. Other objects of the invention will become apparent in the drawings and detailed description.

BRIEF DESCRIPTION OF THE DRAWINGS

FIG. 1 is a sectional view of a bagging machine embodying the present invention taken along a vertical plane;

FIG. 2 is a schematic taken along line 2—2 of FIG. 1, illustrating the position of the bag, in relation to the load;

Figure 3:
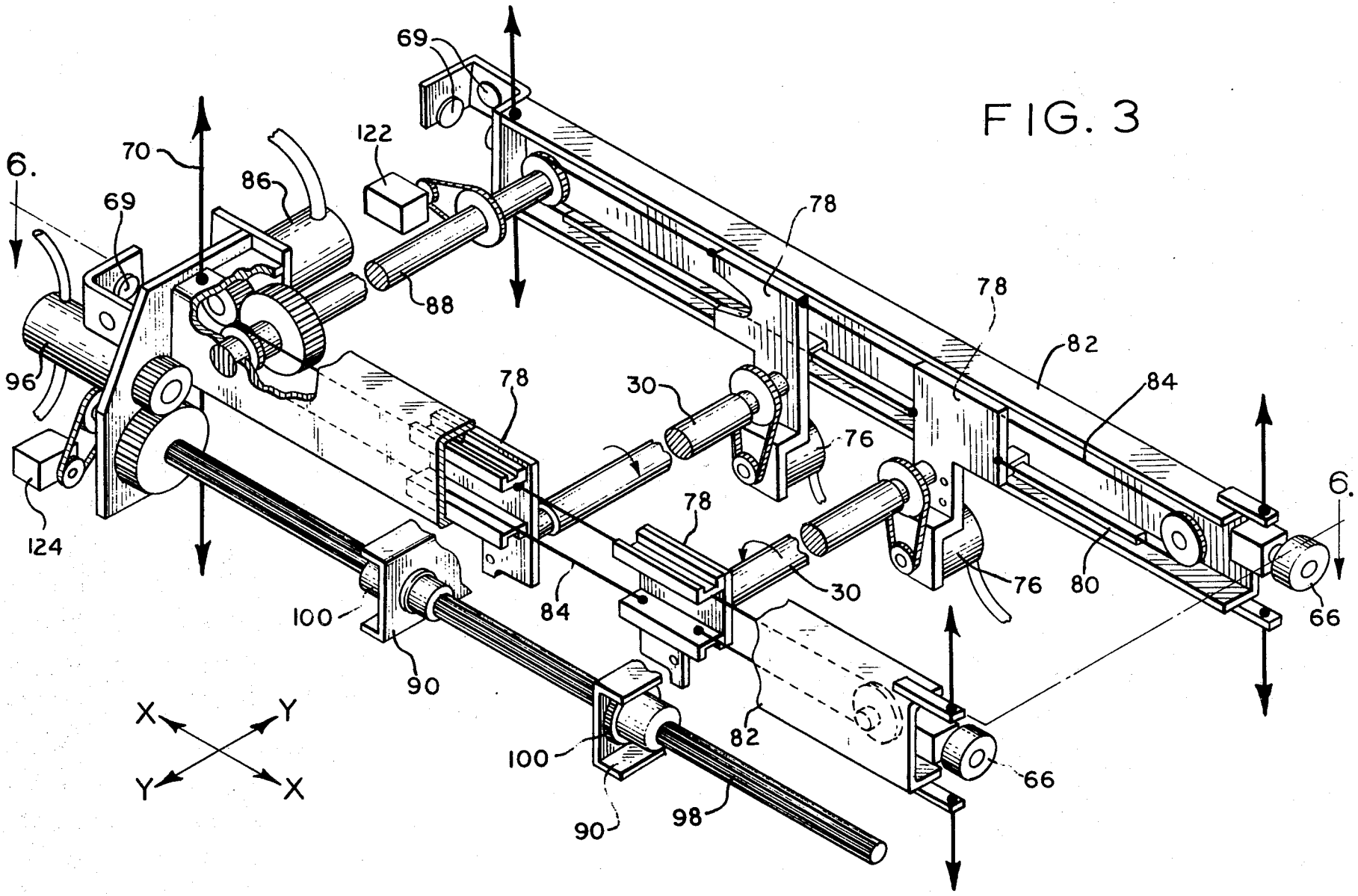
Figure 4:
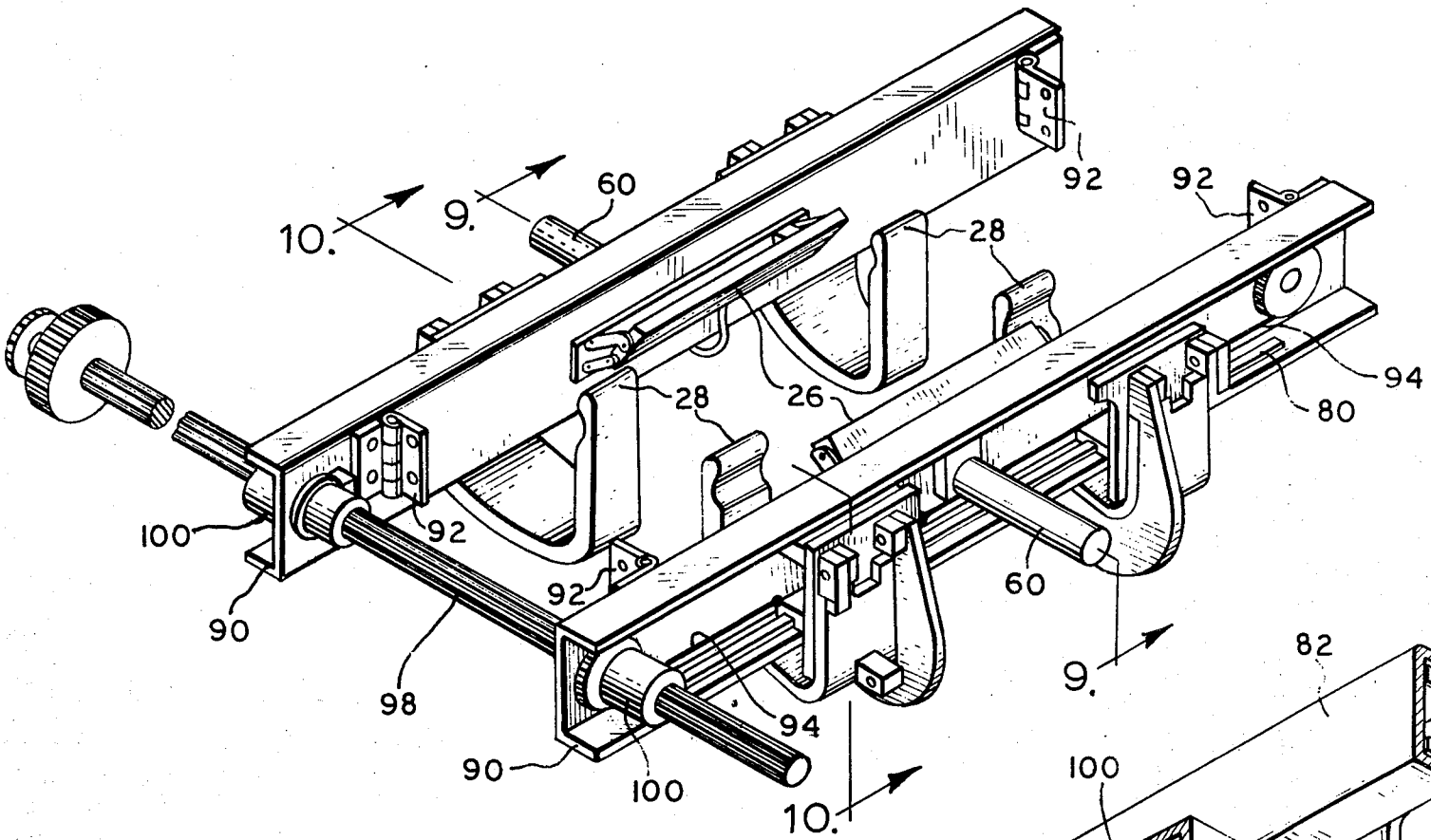
Figure 5:
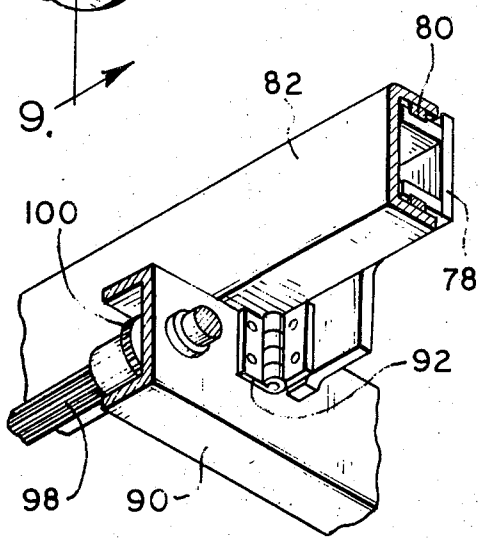
Figure 6:
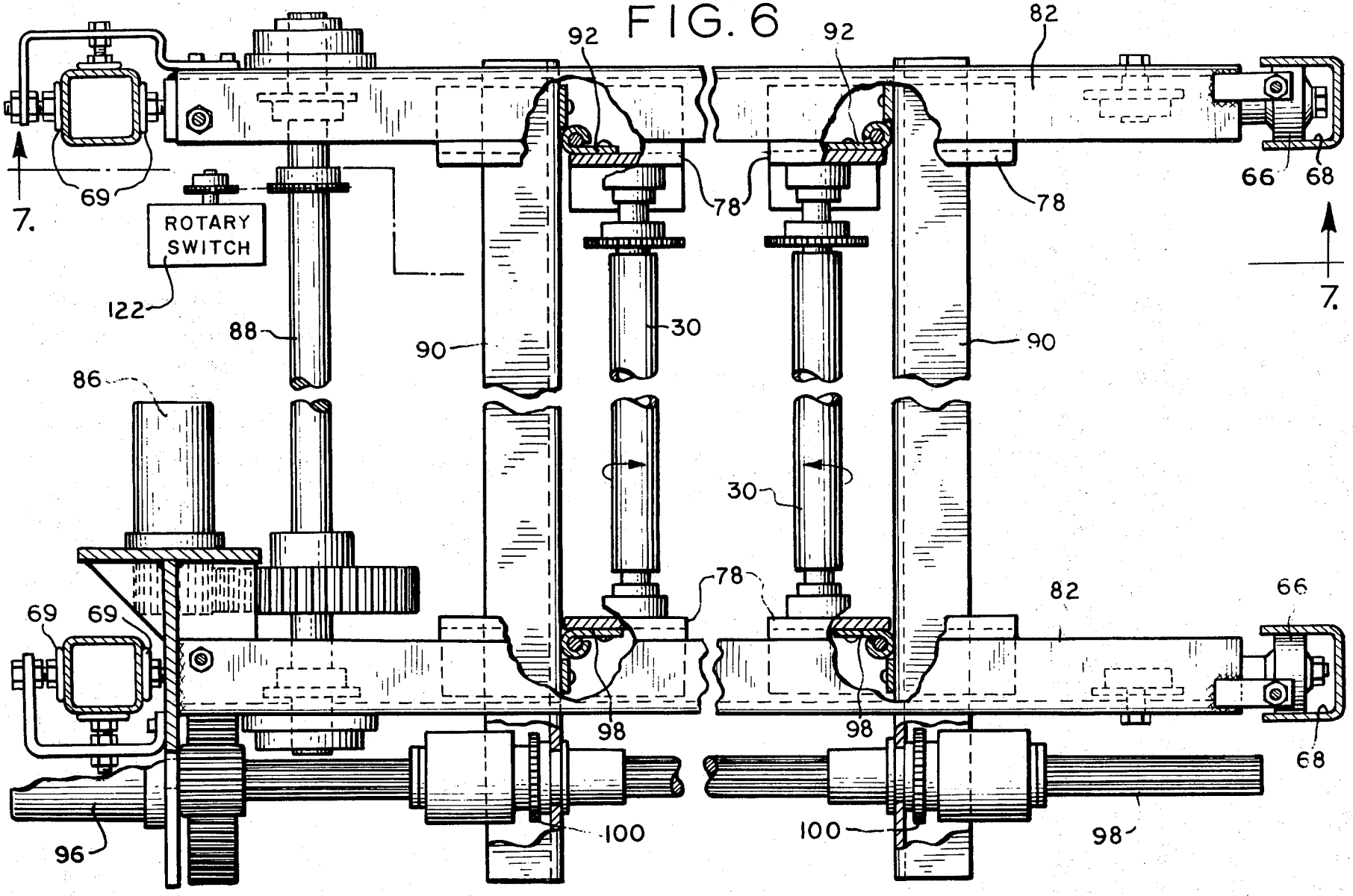
Figures 7, 8, 11, 11A:
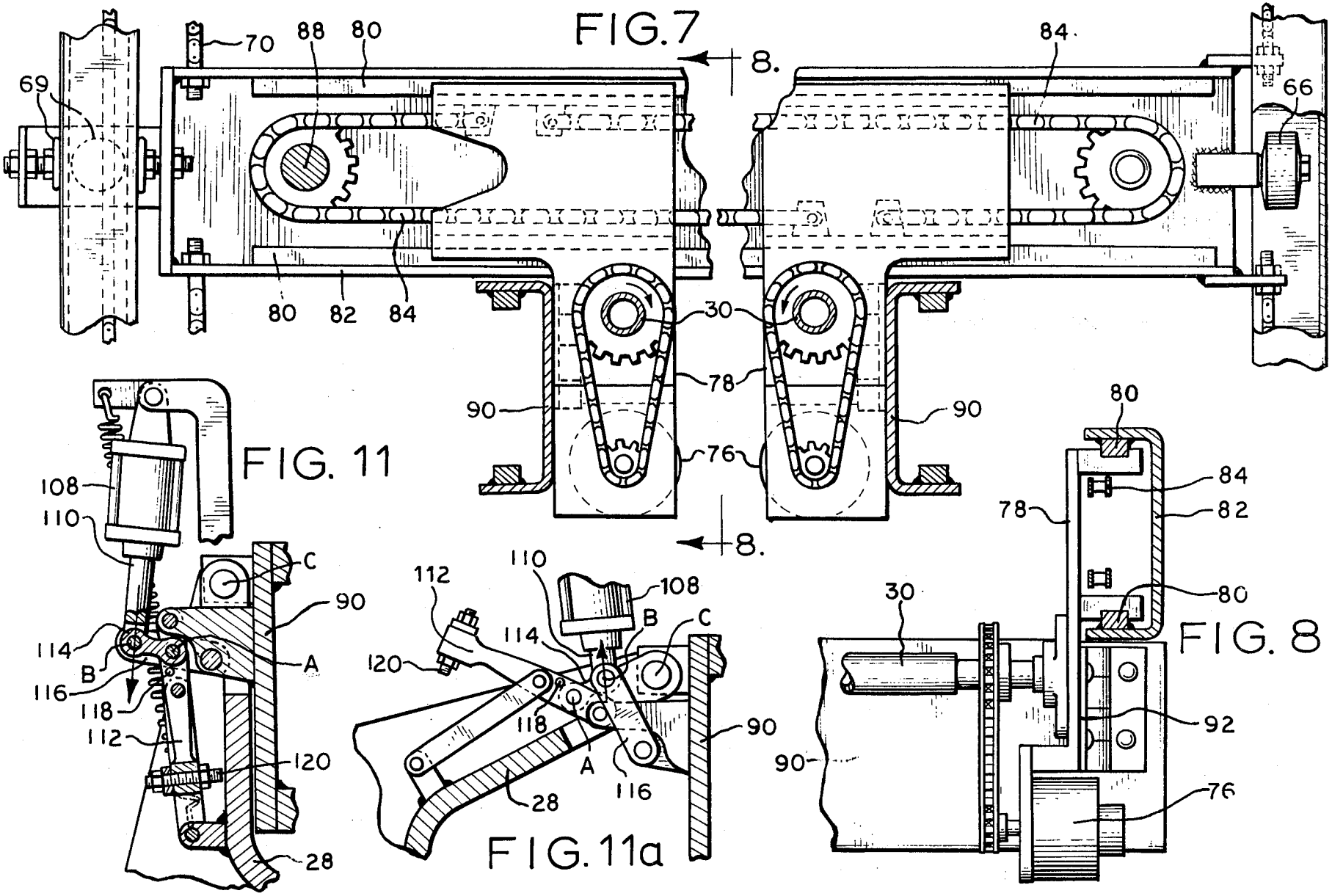
Figure 10:
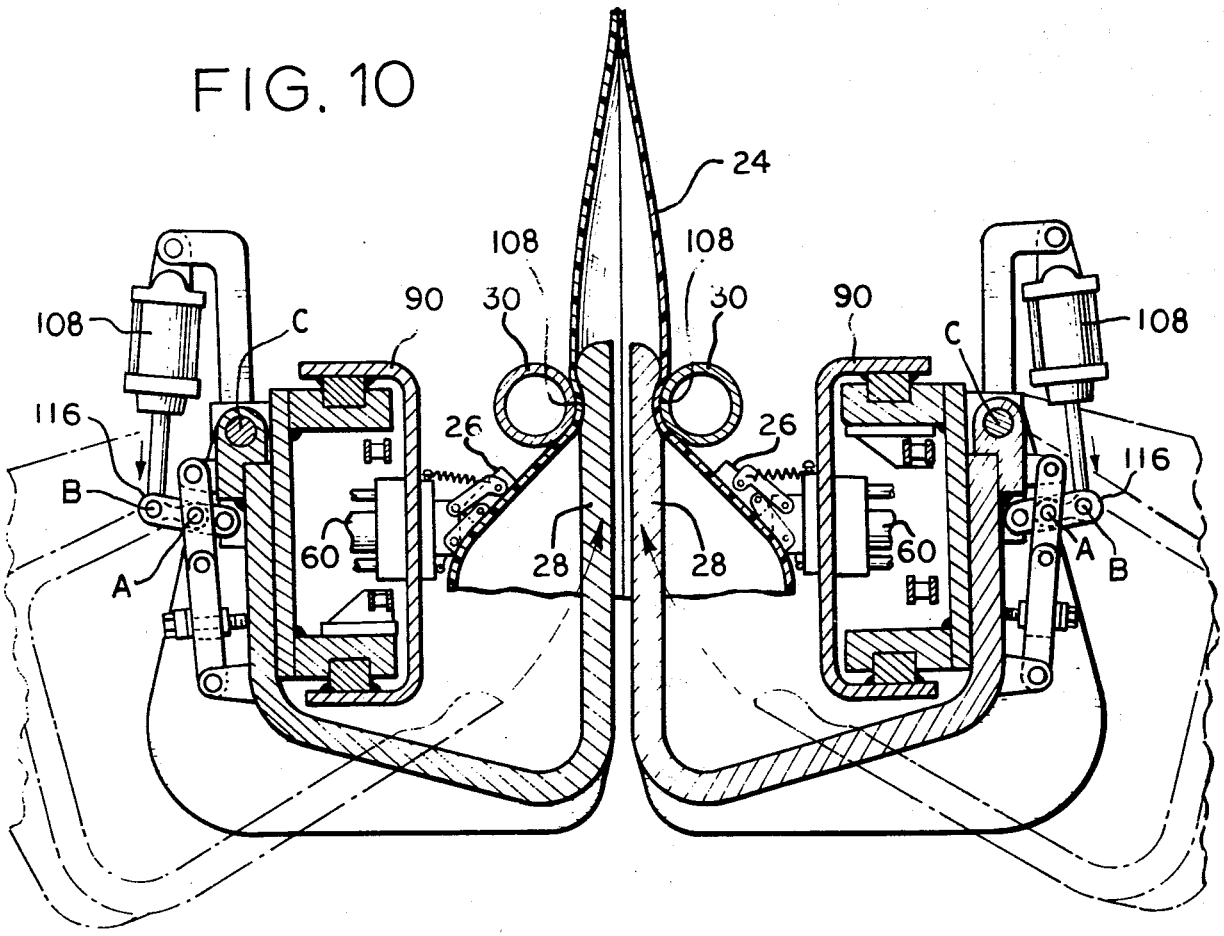
Figure 9:
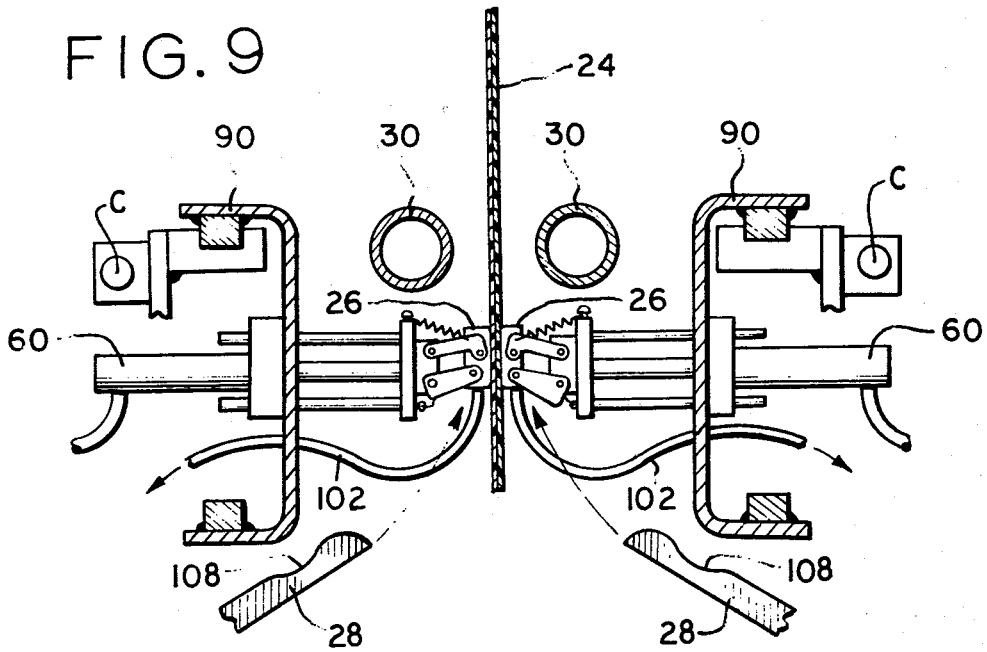
Figure 12:
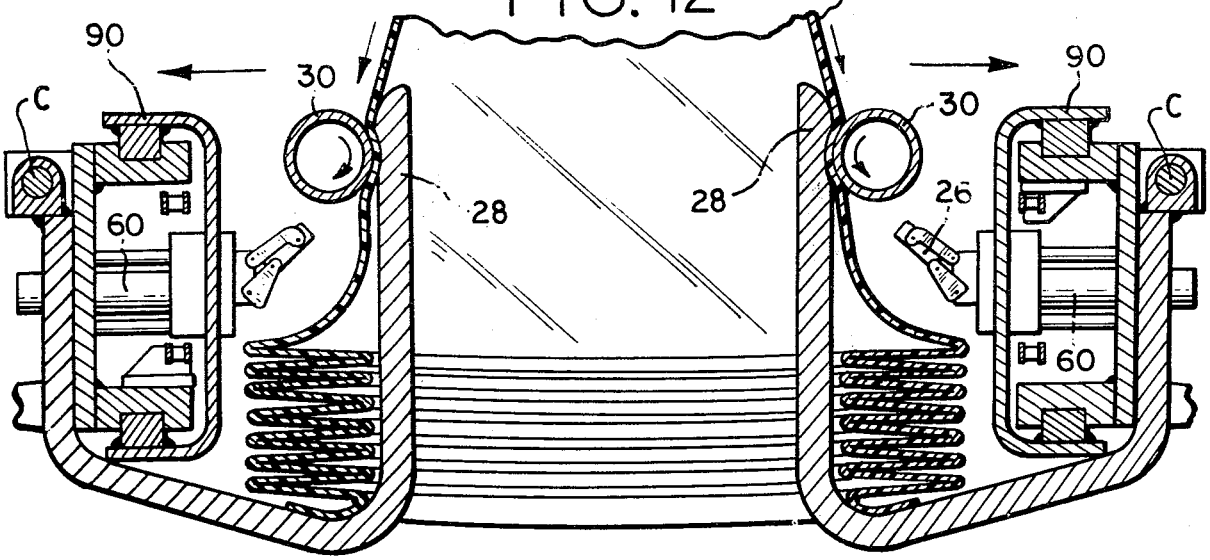
Figure 13:
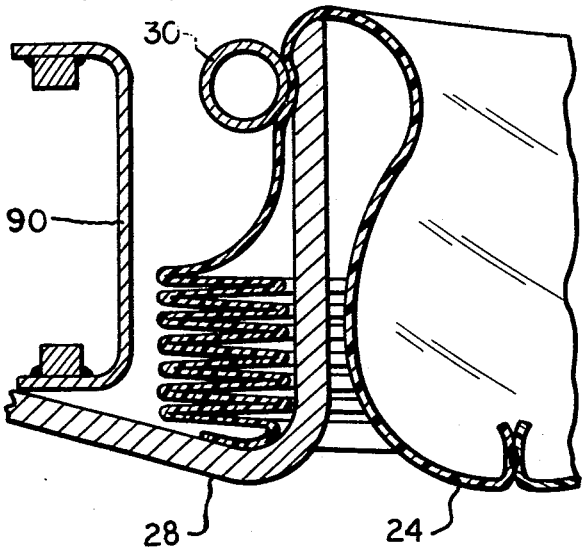
Figure 19:
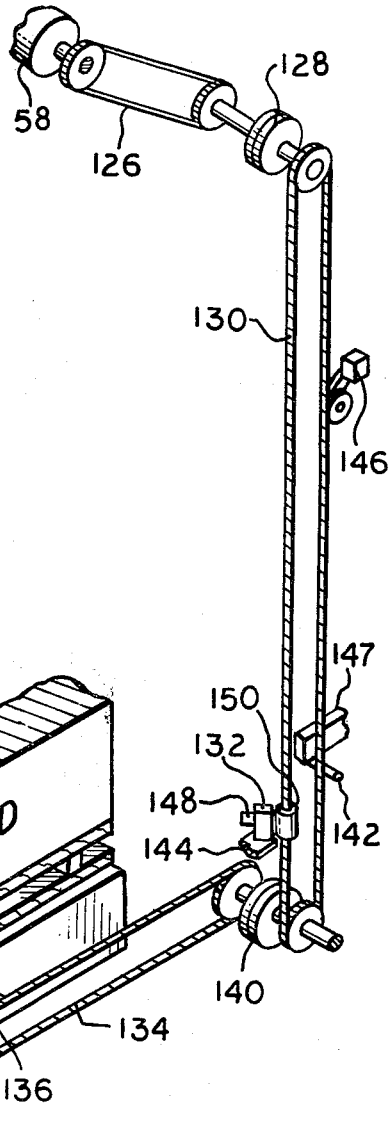
Figure 14:
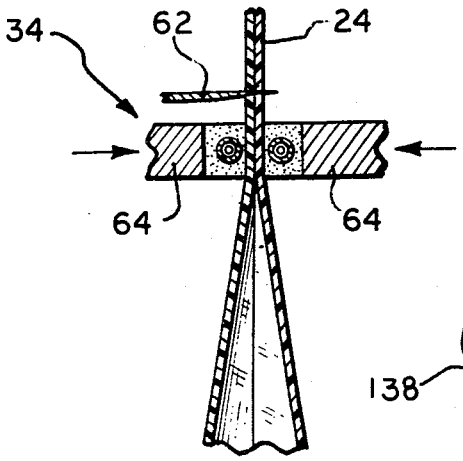
Figure 15:
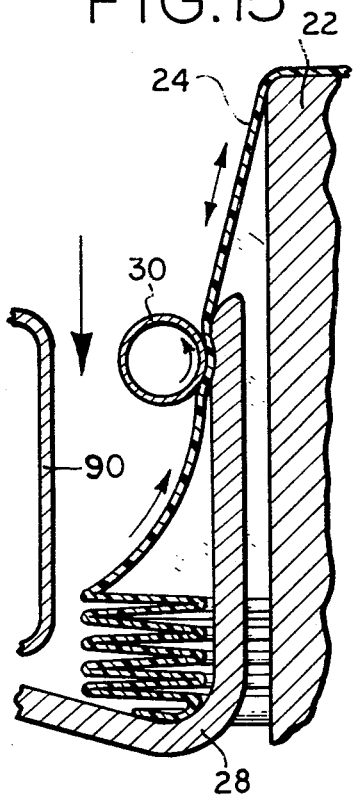
Figure 17:
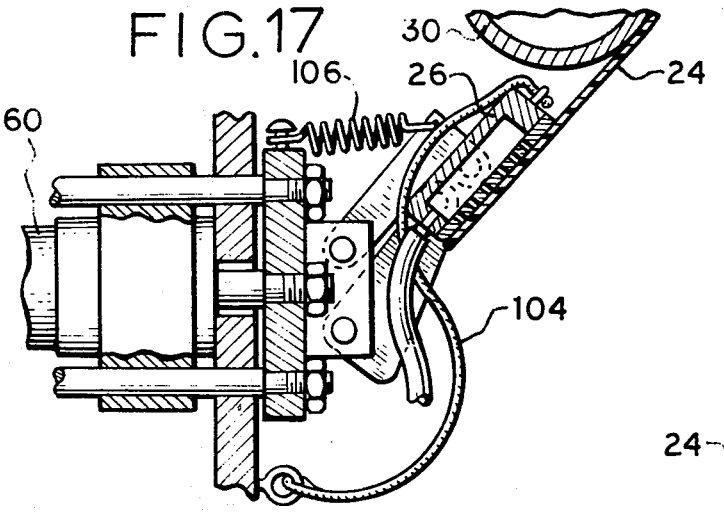
Figure 18:
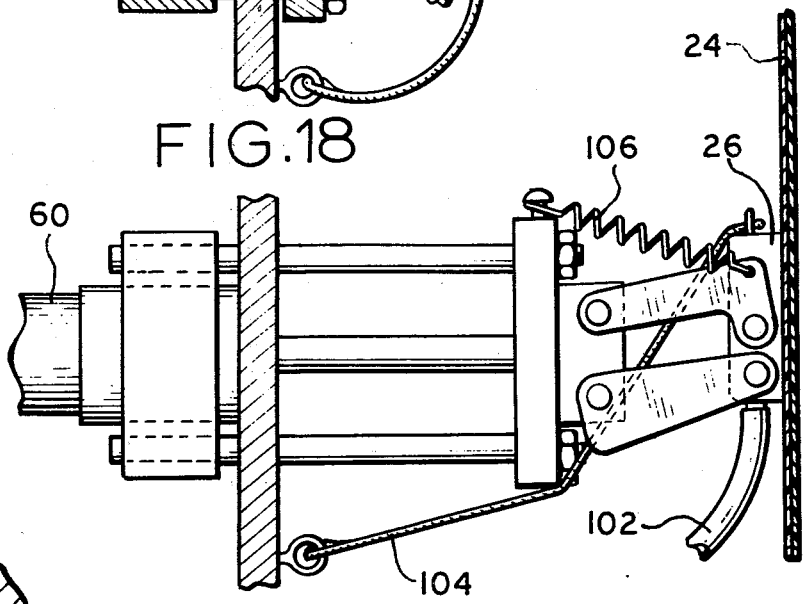
Figure 16:
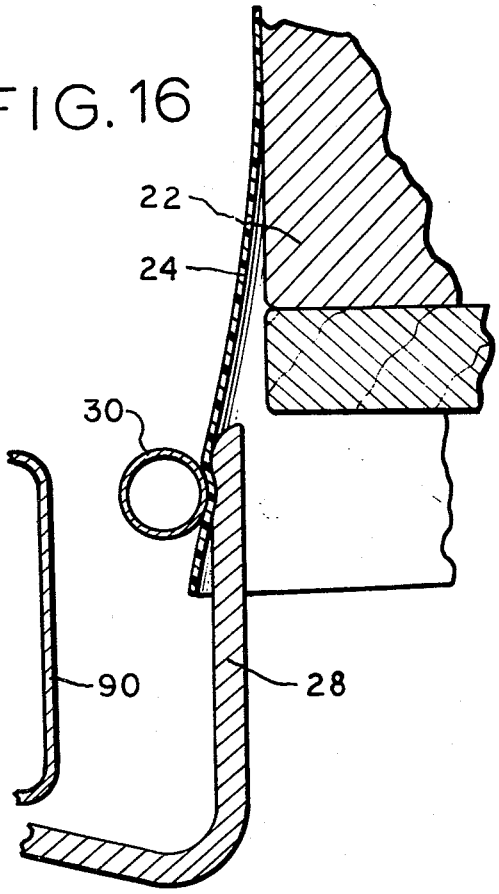

FIGS. *2a, 2b* and *2c* are schematics illustrating the position of the bag at various times in the cycle;

FIG. 3 is a perspective of the upper part of the carriage;

FIG. 4 is a perspective of the lower part of the carriage;

FIG. 5 is a perspective showing one of the mountings between the upper and lower parts of the carriage;

FIG. 6 is a partially cut-away plan view of the upper part of the carriage taken along line 6—6 of FIG. 3;

FIG. 7 is a partially cut-away elevation view of the upper part of the carriage with the face channels included, taken along line 7—7 of FIG. 6;

FIG. 8 is a sectional view of the carriage taken along line 8—8 of FIG. 7;

FIG. 9 is a sectional view of the vacuum means taken along line 9—9 of FIG. 4 prior to the opening of the tubing;

FIG. 10 is a sectional view of the vacuum means taken along line 10—10 of FIG. 4 after the fingers have been inserted;

FIG. 11 is a sectional view of one of the finger mechanisms with the finger tilted forward and inserted in the bag FIG. 11*a* is a sectional view of one of the finger mechanisms with the finger tilted back;

FIG. 12 is a sectional view of two fingers as the tubing is being fed onto the fingers;

FIG. 13 is a sectional view of one of the fingers and the bag after the bag has been formed;

FIG. 14 is a sectional view of the cut-and-seal mechanism;

FIG. 15 is a sectional view of one of the fingers as the bag is being lowered over the load;

FIG. 16 is a sectional view of one of the fingers shortly before the bottom of the bag is reached;

FIG. 17 is a detailed view of the vacuum means in the retracted position;

FIG. 18 is a detailed view of the vacuum means in the extended position; and FIG. 19 is a schematic of the load height sensing mechanism.

DETAILED DESCRIPTION

Referring to FIG. 1, a bagging machine embodying the present invention is indicated generally by the numeral 20. The bagging machine 20 receives a loaded pallet 22 and places the bag 24 over the pallet. As depicted in FIG. *2a*, the bag 24 is formed from gusseted tubing. Polyethylene has been found to be adequate since it has the requisite strength and resilience. As the bag is introduced above the load to be covered vacuum heads 26, which have come into contact with the tubing, retract to open the tubing and allow for the insertion of fingers 28 shown in FIG. *2b*. The fingers 28 retract to further open the bag 24 as shown in FIG. *2c* and the tubing wall is clamped between the fingers and accumulating rollers 30. The accumulating rollers 30 are rotated to feed the bag onto the fingers 28 until the load height sensor 32 indicates that the appropriate length of bag has been collected. A cut-and-seal mechanism 34 then severs the tubing 24 and seals the end thereof to form the bag. The fingers 28 are then further retracted and spread to stretch the bag along the length and width dimensions as shown in FIG. 2. The carriage 36, in which the fingers are carried, is then lowered and the bag 24 allowed to feed onto the loaded pallet.

Referring to FIG. 1, the bagging machine 20 includes a spool 38 of gusseted tubing formed from a resilient film. An additional spool of tubing (not shown) having a different diameter may be mounted above spool 38 if desired. The use of the two sizes of tubing permits a bag to be formed for pallets having varying dimensions. If the second spool is utilized a sensing mechanism is provided for measuring the length and/or width of the pallet to be covered. This enables the machine to select the appropriate spool of large or small diameter tubing. This optional sensing mechanism is of the conventional type described in U.S. Pat. No. 3,897,674. That patent should be referred to for details.

Tubing from spool 38 is threaded through the drive roller 40 and idling nip roller 42 in the bagging machine. The nip roller 42 may be slidably mounted in the frame 44 to simplify tube reloading. Pneumatic cylinders 46 are secured to the frame at each end of the nip roller 42 to provide power for repositioning the roller. If a second tubing spool is added, a second drive roller (not shown) is required. It would normally be positioned above the nip roller 42 so that in its upper position the nip roller would be in contact with the second drive roller. The second tube is fed between these rollers and accordingly, either one or the other of the tubing sizes will be fed down into position for pickup by the vacuum heads, depending upon the position of the nip roller 42.

Roller 48 may be a steering roller with the capability of adjusting the transverse position of the tubing as it is fed over to the drive and nip rollers 40 and 42. The steering function can be accomplished by conventional means, e.g., the roller 48 may horizontally pivot on a fulcrum (not illustrated) near the center of the roller shaft to steer the passing tubing along a straight path.

The tubing is fed by the drive 40 and nip 42 rollers through a cut-and-seal mechanism 34, between the accumulating rollers 30, to the vacuum heads 26 which are brought into position against the tubing. As the vacuum heads retract the sides of the tubing are drawn apart to provide for the entry of the fingers 28 into the tubing. With the fingers so inserted, the accumulating rollers 30 are positioned against the fingers with the tubing wall 24 positioned therebetween. The fingers 28 are partially retracted and the accumulating rollers 30 rotate to feed the tubing onto the fingers as drive 40 and nip rollers 42 feed the tubing off the spool 38.

The length of bag being formed is controlled by the load height sensor 32, as later detailed. The cut-and-seal mechanism 34 is then energized to cut the tubing and seal its end to complete formation of the bag.

The fingers 28 are then further retracted to complete the opening of the bag 24. Ordinarily this will also involve stretching the bag to a size sufficient to encompass the load but the insertion may alternatively be used in non-stretch operations. The carriage 36 is then lowered and the bag is tensioned onto the load. When the bottom of the bag is reached, the bag snaps up under the pallet and the covering is complete.

FIG. 1 depicts a non magnetic, preferably phenolic, wheel 50 with spaced magnets 52 on its periphery mounted on the drive roller shaft 54. As the wheel 50 and the drive roller 40 rotate, tubing is fed down into the apparatus. For each incremental length of tubing fed, e.g., one inch, one magnet passes the reader switch 56. This switch is of the conventional reed type which is sensitive to magnetic fields. As a magnet passes, the magnetic field causes the switch to close. It reopens after the magnet passes. This process is repeated each time a magnet passes the switch with the signal being sent to an impulse counter. When a predetermined number of magnets has passed the switch, which corresponds to the length of tubing which must be fed from the cut-and-seal mechanism down to a point slightly below the vacuum heads, the impulse counter in the reader switch 56 cuts out feed motor 58 and activates vacuum system pnematic cylincers 60 and the finger-positioning mechanism, thus causing the vacuum heads 26 to extend out to the tubing 24.

The cut-and-seal mechanism 34 may be of any conventional construction. The mechanism shown in detail in FIG. 14 includes a movable knife 62 and clamping jaws 64. In the operation of the cut-and-seal mechanism, the jaws 64 are closed on the tubing and the knife 62 is operated to cut the tubing. The jaws 64 are then heated at the lower portion thereof to seal the end of the tubing and complete formation of the bag. It is to be noted that ordinarily the top of the bag will be completely sealed but the heating elements may be modified so to provide openings along the top.

Referring to FIG. 1, the carriage 36 in which the fingers 28 are carried is mounted in the frame 44 so to allow vertical movement. FIG. 3 shows rollers 66 which run in a vertical slot 68 in two of the legs of the frame and alignment glides 69 which circumscribe the other two legs. Lift chains 70 and 72 which are driven off of the lift motor 74 via the carriage drive shaft 75 are provided at each end of the frame. A carriage rotary limit switch 77 is provided to measure the vertical travel of the carriage 36 and control the lift motor 74 accordingly.

In addition to vertical movement the carriage 36 provides the fingers 28 with capability to move in two horizontal directions, illustrated as X and Y. The X component is provided by the upper section of the carriage and the Y component by the lower section.

The mechanism providing the X component is shown in FIGS. 3 and 7. The accumulator roller 30 and the accumulator roller motors 76 are fixed to the face channel mounting plates 78 which are slidably mounted on the key stock 80 of the carriage channels 82 to allow for movement in the X direction. Carriage channel drive chains 84 secured to adjacent face channel mounted plates 78 move the two accumulator rollers 30 in opposite directions along the X component. The X-drive motor 86 mounted on the carriage 36 drives the carriage channel drive chains 84 via the carriage channel drive shaft 88. The face channels 90 in which the fingers 28 are carried, are flexibly fixed to the face channel mounting plates 78, here by hinges 92. Accordingly, as the accumulating rollers 30 move toward each other along the X component, so do the fingers 28 which are to be inserted under the bag 24.

As depicted in FIG. 4, the fingers 28 are mounted on the key stocks 80 of the face channels 90 to allow movement in the Y direction. Face channel drive chains 94 move the fingers in opposite directions along the Y component. The Y-drive motor 96 mounted on the carriage 36 drives these chains via the spline 98 is which the face channels are slidably mounted. Ballspline bearings 100 are mounted in the face channels 90. Accordingly, the face channels are free to move in the X direction along the spline while the spline is driving the finger assemblies in the Y direction. Referring to FIGS. 9 and 10, the vacuum head assemblies are mounted on the face channels 90. When the ready switch indicates that the tubing has reached a low enough point a pneumatic cylinder 60 behind each face channel 90 forces the vacuum heads 26 into the extended position and the face channels are moved to their inner most position. A vacuum is then pulled from a vacuum apparatus, preferably a vacuum pump (not shown), via the vacuum tubes 102, and the bag is grasped. A cable 104 forces the head 26 into the fully extended position when the pneumatic cylinders 60 extend the heads as in FIG. 18. The pneumatic cylinders 60 then retract the vacuum heads and a biasing spring 106 depicted in FIGS. 17 and 18 pulls the head into an upper position. The tangential movement of the vacuum head 26 caused by the biasing spring 106 prevents the tubing 24 from sliding along head which could result in loss of vacuum. Matching cutouts (not shown) may be drilled in the vacuum heads so that if the tubing is not in place between the heads, the heads will not pull a vacuum against each other but rather will prevent a vacuum from being pulled at all.

After the tubing is spread open by the vacuum heads the fingers 28 are tilted forward and inserted under the bag between the accumulator rollers 30 as shown in FIG. 10. A cut-out 108 is provided on the inner side of each finger below the tip to insure proper positioning relative to the accumulating rollers. Spring plungers (not shown) may be mounted on the face channel mounting plates 90 to bias the accumulator rollers 30 toward the fingers to insure proper gripping of the tubing. The fingers are driven by a conventional lock over center mechanism which provides the greatest force as the fingers approach the final position. FIGS. 11 and 11*a* depict the preferred mechanism in the two extreme positions. In describing this mechanism several pivot points will be referred to, designated as A, B, and C. A hydraulic cylinder 108 provides power for the mechanism. FIG. 11*a* shows the power rod 110 in the retracted position with the finger 28 tilted back. When the finger is to be inserted into the bag the power rod 110 begins to extend and the throw lever 112 is rapidly forced downward through pivot point A. This begins to move finger 28 which pivots on point C. As this is happening, the power toggle 114 is moving on points A and B and B is rotating over A in a counterclockwise direction. As the finger continues to swing and it nears its final position the power link 116 approaches the stop pin 118 and the contact bolt 120 approaches the back of the finger 28.

As the finger reaches its final position the stop pin 118 and the contact bolt 120 stop the finger. When the fingers are retracted the sequence is reversed.

After the fingers 28 are in position and the tubing wall is clamped between the accumulating rollers 30 and the fingers, the fingers are moved by the X and Y motors to a partially open position. The exact amount of travel can be controlled by the carriage channel rotary limit switch 122 and the spline rotary limit switch 124 respectively which measure the rotation of the carriage channel driveshaft 88 and the spline 98, and which cut out the X 86 and Y 96 motors when the fingers are properly positioned.

The accumulating rollers 30 are then rotated to feed the proper bag length onto the fingers. The proper amount is determined by the load height sensor mechanism. This mechanism can be of the type described in U.S. Pat. No. 3,897,674 but a preferred arrangement is that depicted in FIG. 19. An intermediate sensor drive chain 126 transfers power from the feed motor 58, through a sensor drive clutch 128 to a sensor drive chain 130. The sensor drive chain 130 operates to raise the load height sensor 132 as detailed.

A length programming chain 134 is affixed to a connecting link 136 on the centering trolley 138. As the centering trolley moves between the longitudinal centerline of the machine and the longitudinal centerline of the loaded pallet, the programming chain 134 is moved by the connecting link 136. The movement of the programming chain 134 is transfered to the sensor drive chain via a programming clutch 140.

The length of tubing to form the bag is determined by the size of the loaded pallet. The length of tubing required is equal to one-half the width across the top of the loaded pallet, plus the height of the loaded pallet, plus the length of tubing, if any, desired under the pallet. The sensor drive chain 130 rotates when the drive roller 40 is being driven to feed tubing.

A lift pin 142 is attached to the sensor drive chain 130 for engaging the load height sensor 132 and raising the sensor vertically as the chain is driven. The lift pin 142 is positioned at a pre-load distance from the load height sensor at a distance equal to one-half the width of the loaded pallet plus any length desired under the pallet. The preset distance of the lift pin 142 is controlled by the programming chain 134 which moves the sensor drive chain 130 via the engaged programming clutch 140 during centering of the loaded pallet.

After the trolley 138 is centered and the programming clutch 140 is disengaged, the feed motor 58 and the accumulating roller motors 76 begin to feed bagging onto the fingers. Since the sensor drive clutch 128 is engaged, the feed motor is also driving the sensor drive chain 130.

The drive roller continues feeding tubing until the load height sensor 132 reaches the top of the loaded pallet. The sensor then stops the feed motor 58 and the accumulating roller motors 76 and disengages the sensor drive clutch 128 thus causing the sensor to drop to its initial position against the lower stop 144. Weights and/or counter-weights (not shown) may be added to insure the proper rate of descent. A rotary limit switch 146 is provided which measures the travel of the sensor drive chain 130. This switch partially engages the sensor drive clutch 128 as the dropping sensor approaches the lower stop 144. The weights and/or counterweights cause the sensor drive chain 130 and the lift pin 142 carried therein to continue to rotate until the lift pin 142 comes to rest against the lift pin stop 147. The rotary limit switch has an additional purpose. To prevent damage to the machine if the sensor fails to cut-out the feed motor the limit switch disengages the sensor drive clutch if the sensor ascends higher than it should.

When the sensor 132 reaches the top of the load and cuts out the feed motor, a sufficient amount of tubing has been fed past the drive roller to form the necessary length of bag. The cut-and-seal mechanism is then actuated and the formation of the bag is completed.

Originally, the sensor drive chain is automatically set to a home position by the mechanism described above. In this set position, the lift pin 142 rests against the lift pin stop 147 which is at a distance from the load height sensor 132 equal to half the width of the largest pallet plus any desired length under the pallet plus any necessary operating clearances. The position of the lift pin stop 142 is adjustable to accomodate changes in these requirements. When the centering trolley 138 returns from the longitudinal centerline of the machine, the programming clutch 140 is engaged while the drive clutch 128 is disengaged, and the programming chain 134 moves to the sensor chain 130 forward an amount equal to the difference between width of the pallet being loaded and the half width of the largest pallet. Thus, the programming chain 134 and associated mechanisms serve to set the half width of the pallet being loaded into the sensor drive chain 130 for use as a preload to the length sensor.

The load height sensor 132 includes a photocell 148 positioned on the sensor body. Fixed to the sensor body is a sleeve 150 through which the sensor drive chain 130 passes. The lift pin 142 is transversely mounted in the sensor drive chain and extends beyond the inner dimension of the sensor sleeve 150 so that as the sensor drive chain rotates and the lift pin comes into contact with the sleeve the sensor is lifted.

The operation of the entire bagging machine will now be described. The centering trolley 138 is moved by a hydraulic cylinder into alignment with the longitudinal centerline of the pallet to be covered as indicated by the side sensor. This centering trolley is of conventional design. For a detailed description of the preferred centering mechanism, refer to U.S. Pat. No. 3,897,674. The pallet is placed on the centering trolley, the drive clutch is disengaged, and the trolley is returned to the longitudinal centerline of the machine. During the return of the trolley 138, the programming chain 134 moves the sensor drive chain 130 forward via the engaged programming clutch 140 to the appropriate preload length setting for the size of the pallet.

After the centering trolley 138 returns to the home position with the pallet properly centered in the machine, the programming clutch is disengaged, the sensor drive clutch is engaged and the feed motor 58 is started. The drive roller 40 thus rotates to feed tubing down between the accumulator rollers 30. The sensor drive clutch 128 is engaged so the sensor drive chain 130 is also rotating. When the lift pin 142 comes into contact with the sensor sleeve 150, the sensor will begin its ascent. When the reader switch 56 senses that a sufficient amount of tubing has been fed, the switch stops the feed motor 58 and activates the pneumatic cylinders 60 which extend the vacuum heads 26 and the X-motor 86 which moves the face channels 90 to the inner most position. A vacuum is then drawn and the tubing is grasped. When vacuum is achieved the pneumatic cylinders 60 are retracted and the bias spring 106 pulls the vacuum heads 76 into the upper position to spread open the tubing.

The finger mechanisms are then energized and the fingers 28 are inserted into the tubing between the accumulator rollers 30. At this point the X-motor 86 is activated to open the face channels 90 and the fingers carried therein, and the Y-motor 96 is activated to open the fingers 28 along the face channels 90 via the spline 98. When the carriage channel rotary limit switch 22 and the spline rotary limit switch 124 determine that the bag 24 has been opened sufficiently, the X and Y-motors are cut-out and accumulator roller motors 76 and the feed motor 58 are activated to feed tubing onto the fingers, as shown in FIG. 12. The sensor drive coupling 128 is still engaged so the sensor drive chain 130 also begins to rotate thus causing the sensor 132 to ascend.

When the sensor 132 sees the top of the load, the feed motor 58 and the accumulator roller motors 76 are cut-out, the cut-and-seal mechanism 34 is activated. Upon completion of the cut-and-seal cycle, the top of the newly-formed bag drops down, as depicted in FIG. 13. Also at this time the sensor drive clutch 128 is disengaged, allowing the sensor drive chain 130 and the sensor carried thereon to drop. When the sensor 132 approaches the bottom stop 144 the rotary limit switch 146 partially engages the sensor drive clutch 128 to dampen its fall and the lift pin 142 and sensor drive chain 130 continue until the lift pin comes to rest against the lift pin stop 147.

After the bag has been cut-and-sealed, the X and Y-motors 86 and 96 are again activated and the fingers 28 stretch the bag 24 to points sufficient to encompass the load.

The lift motor 74 is next energized and the lift chains 70 and 72 lower the carriage over the loaded pallet. The accumulating roller motors 76 allow the accumulating rollers to idle in reverse but provide some resistance. This results in a vertical stretching force being exerted on the bag 24 as it is fed onto the load, as depicted in FIG. 15. When the load is completely covered and the carriage is at its lower point of travel, the carriage rotary limit switch 77 causes the finger mechanisms to tilt the fingers back and the lift motor 74 reverses direction to raise the carriage 36 to the starting position. The Y motor 96 is then energized to move the finger mechanisms into their innermost position in preparation for the introduction of the next section of tubing.

While the present invention can be used with a wide variety of bag compositions, some bags tend to bunch while being allowed to feed onto the load. To prevent bunched tubing from slipping past one of the fingers as the tubing from the adjacent finger causes the accumulator roller to rotate, a split sleeve may be put on each end of the roller. This prevents bunched tubing from slipping past the roller by allowing the sleeve to slip on the rotating roller while the bunched tubing feeds itself out as the carriage is being lowered. Another arrangement which would prevent the action of one finger from disrupting the feeding past another finger would be to provide a separate accumulator roller for each finger.

It is to be understood that various modifications can be made to the disclosed bagging machine without departing from the scope of the invention, and it is intended to cover in the appended claims all such modifications as fall within the true spirit and scope of the invention.

What is claimed is:

1. An improved bagging machine for covering a load with a bag formed from tubing of the type having means for feeding tubing to a work area for receiving the tubing, means for gripping the tubing, and spreading the tubing to an open position, fingers which are insertable into the tubing which has been spread open, means for severing the tubing and forming the bag therefrom, the bag being collected on the fingers, and means for providing relative vertical movement between the fingers and the load to cover the load with the bag collected on the fingers, wherein the improvement comprises:

means for retracting the fingers simultaneously along mutually perpendicular horizontal components so that after the fingers have been inserted into the tubing, the tubing may be spread open outward to a position which will encompass the load.

2. The bagging machine of claim 1 wherein the means for retracting the fingers outward comprises two substantially parallel channels in which the fingers are slidably mounted and means for moving the channels toward and away from each other.

3. The bagging machine of claim 2 wherein the means for providing relative vertical movement lowers the channels over the load.

4. The bagging machine of claim 2 further comprising means for tilting the fingers backwards prior to the opening of the tubing and forward for insertion into the tubing.

5. The bagging machine of claim 2 wherein the means for spreading the tubing comprises vacuum heads and means to extend and retract the vacuum heads.

6. The bagging machine of claim 5 further comprising reader means to measure the travel of the tubing so that the vacuum heads can be extended at the proper time.

7. The bagging machine of claim 6 wherein the reader means comprises a non-magnetic wheel with spaced magnets mounted therein which rotates as tubing is fed to the work area, and a reader switch positioned adjacently thereto so that as tubing is fed, the magnets pass the reader switch which can determine how much tubing has been fed.

8. The bagging machine of claim 1 further comprising means for positively feeding the tubing onto the fingers after the fingers have been inserted.

9. The bagging machine of claim 8 further comprising means for tension feeding the tubing off the fingers onto the load as relative movement is effected.

10. The bagging machine of claim 9 wherein the means for tension feeding the tubing off the fingers and the means for feeding the tubing onto the fingers comprise rollers positioned adjacent to the fingers so that when the fingers have been inserted into the tubing the tubing is positioned between the rollers and the fingers.

11. The bagging machine of claim 10 wherein the rollers comprise two rotatable shafts, each positioned adjacent to two fingers.

12. The bagging machine of claim 1 wherein the means for retracting the fingers outward comprises face channels in which the fingers are slidably mounted and carriage channels in which the face channels are slidably mounted, said face channels being substantially perpendicular to said carriage channels.

13. An improved bagging machine for covering a load with a bag having means for spreading the bag into an open position, fingers which are insertable into the bag which has been spread open, and means for effecting relative vertical movement between the fingers and the load to cover the load with the bag collected on the fingers, wherein the improvement comprises:

means for retracting the fingers outward along a first horizontal component;

means for retracting the fingers outward along a second horizontal component, wherein the first and second horizontal components are mutually perpendicular, so that after the fingers have been inserted into the bag, the bag may be selectively spread open to a position which will encompass the load.

14. The bagging machine of claim 13 wherein the respective means for retracting the fingers outward act simultaneously to spread the bag open in one spreading movement.

15. The bagging machine of claim 13 further comprising means for positively feeding the tubing onto the fingers after the fingers have been inserted.

16. The bagging machine of claim 15 further comprising means for tension feeding the tubing off the fingers onto the load as relative movement is effected.

17. The bagging machine of claim 16 wherein the means for tension feeding the tubing off the fingers and the means for feeding the tubing onto the fingers comprise rollers positioned adjacent to the fingers so that when the fingers have been inserted into the tubing the tubing is positioned between the rollers and the fingers.

18. The bagging machine of claim 17 wherein the rollers comprise two rotatable shafts, each positioned adjacent to two fingers.

19. The bagging machine of claim 13 wherein the respective means for retracting the fingers outward comprises two substantially parallel channels in which the fingers are slidably mounted and means for moving the channels toward and away from each other.

20. The bagging machine of claim 13 wherein the means for retracting the fingers outward along a first horizontal component comprises face channels in which the fingers are slidably mounted and the means for retracting the fingers outward along a second horizontal component comprises carriage channels in which the face channels are slidably mounted.

* * * * *